US006540187B2

(12) United States Patent
Carter

(10) Patent No.: US 6,540,187 B2
(45) Date of Patent: Apr. 1, 2003

(54) ADJUSTABLE MOUNTING BRACKET

(76) Inventor: Godwin Carter, Pact 2/85 Somerset Road, Campbell Field, Victoria 3061 (AU)

( * ) Notice: Subject to any disclaimer, the term of this patent is extended or adjusted under 35 U.S.C. 154(b) by 0 days.

(21) Appl. No.: 09/782,919

(22) Filed: Feb. 13, 2001

(65) Prior Publication Data

US 2001/0007344 A1 Jul. 12, 2001

Related U.S. Application Data

(63) Continuation of application No. 09/261,722, filed on Mar. 3, 1999, now Pat. No. 6,186,457.

(51) Int. Cl.[7] ..... A47H 1/14; E06B 9/30

(52) U.S. Cl. ..... 248/251; 248/254; 248/542; 160/178.1 R; 160/902

(58) Field of Search ..... 248/251, 262, 248/254, 221.11, 544, 201, 225.21, 253, 259, 265, 229.12, 229.22, 227.1, 227.4, 228.3, 231.41, 542; 160/175.1 R, 902

(56) References Cited

U.S. PATENT DOCUMENTS 4,340,199 A * 7/1982 Brock ..... 248/544
4,475,706 A * 10/1984 Anderson ..... 248/542
4,938,443 A * 7/1990 Rowe ..... 248/251
4,949,926 A * 8/1990 Liu ..... 248/251
5,074,350 A * 12/1991 Carter ..... 160/178.1 R
5,121,893 A * 6/1992 King et al. ..... 248/251
5,186,426 A * 2/1993 Wada ..... 248/251
5,195,570 A * 3/1993 Marocco ..... 160/178.1 R
5,230,493 A * 7/1993 Luoto ..... 248/251
5,533,560 A * 7/1996 Morris ..... 160/178.1 R
5,816,308 A * 10/1998 De Hoyos ..... 160/178.1 R

* cited by examiner

*Primary Examiner*—Anita King
(74) *Attorney, Agent, or Firm*—Knobbe Martens Olson & Bear LLP

(57) ABSTRACT

The bracket includes an inner body having a hook on one end and arranged to slide within an outer body having a hook on one end to provide a variable bracket length. A pair of springs located between overlapping portions of the bodies biases the bracket towards its longer uncompressed length. After the bracket is mounted to a support surface, a wall of the headrail is hooked onto the hook of the inner body. The headrail is then advanced to compress the springs and shorten the bracket length so that an opposite wall of the headrail can catch on the hook of the outer body. Removing the compression force on the springs biases the bracket toward its longer length to capture the second wall of the headrail with the hook of the outer body. By this arrangement, an easily applied pushing force installs and attaches the mounting bracket to the headrail.

14 Claims, 9 Drawing Sheets

ADJUSTABLE MOUNTING BRACKET

RELATED APPLICATION

This application is a continuation of application Ser. No. 09/261,722, filed Mar. 3, 1999 now U.S. Pat. No. 6,186,457.

BACKGROUND OF THE INVENTION

1. Field of the Invention

The present invention relates generally to an adjustable mounting bracket and more specifically to an easily installable adjustable mounting bracket for coupling a window treatment headrail to a support surface.

2. Description of the Related Art

Window treatments, such as Venetian blinds, vertical blinds, drapes and the like, are typically supported by an elongated headrail. The headrail is coupled to a support surface, such as a wall or ceiling, through a mounting bracket.

A variety of mounting brackets are disclosed in the prior art. One type of mounting bracket is an outside mount bracket, which extends around the headrail and is readily observable to a casual viewer. Outside mount brackets, however, detract from the aesthetic view of the window treatment and further require manufacture in a variety of colors to blend with the headrail and/or window treatment.

Another type of mounting bracket is an inside mount bracket. Inside mount brackets mount inside the headrail and thereby overcome the aesthetic shortcomings of outside mount brackets. However, inside mount brackets require close tolerances to assure a tight, secure fit between the bracket and headrail.

A more recent type of inside mount bracket provides an adjustable feature having one or more portions of the bracket which adjust to fit within the headrail. Although adjustable inside mount brackets can overcome many of the shortcomings of non-adjustable inside mount brackets, they are difficult to install and/or fail to provide a secure fit within the headrail. For example, U.S. Pat. No. 4,949,926 to Liu requires that the installer initially attach the mounting bracket to the support surface; then elevate the headrail to the support surface; then hook one end of the headrail onto a holder; then, while keeping the headrail elevated and the holder hooked onto the hook, pull a slidable block outward until the opposite end of the headrail is hooked onto a second holder. This operation demands a significant amount of physical strength and dexterity.

A need therefore exists for an easily installable mounting bracket for coupling a window treatment headrail to a support surface. A need also exists for a universal mounting bracket that can be used to securely couple one object to another object. A need further exists for an unobtrusive mounting bracket that can be inexpensively manufactured without detracting from the aesthetic appearance of the window treatment and/or headrail.

SUMMARY OF THE INVENTION

One aspect of the present invention provides an easily installable mounting bracket for coupling a window treatment headrail to a support surface. The bracket achieves this function through an adjustable feature that allows one portion of the bracket to be moveable relative to another portion of the bracket.

Briefly stated, the bracket, includes an inner body having one or more hooks and an outer body having one or more hooks. The inner body is arranged to overlap and longitudinally slide relative to the outer body. This arrangement provides variable adjustment of the longitudinal length of the bracket, as defined by the combined overlapping longitudinal lengths of the inner and outer bodies. A biasing member, preferably a spring, is at least partially located between the overlapping portions of the inner and outer bodies. The spring, when compressed, provides a force capable of biasing the bracket back towards its original uncompressed length.

In operation, after the bracket is mounted to the support surface, a first end of the headrail is hooked onto the hook of the inner body. A force is then applied to the headrail, which moves the inner body toward the outer body, thereby decreasing the longitudinal length of the bracket and compressing the spring. The headrail is then rotated so that the second, opposite end of the headrail extends beyond and over the hook on the outer body. The applied force is then removed, which causes the spring to bias the bracket back toward its original longitudinal length. As the bracket returns toward its original length, the second end of the headrail contacts the hook of the outer body and becomes hooked thereon. By this arrangement, an easily applied pushing force installs and attaches the mounting bracket to the headrail.

In accordance with one aspect of the invention, the bracket couples a U-shaped headrail of a window treatment to a support surface. The bracket comprises a generally elongate outer body having a hook on one end for engaging one side of the headrail, and an inner body overlapping the outer body and having a hook on the end opposite the outer body hook for engaging another side of the headrail. The bracket also has a biasing device arranged between the outer body hook and the inner body hook configured to provide a bias to move the inner body away from the outer body to capture the headrail.

In accordance with another aspect of the invention, the bracket couples an object to a support structure. The bracket comprises a body having a first end with a hook and a second end with a hook. The second end is slidable with respect to the first end to adjust the length of the bracket. The first end is adapted to be fixed to the support structure. The bracket also has a biasing device which biases the second end away from the first end to lengthen the bracket. By this configuration, compressing the biasing device allows the hooks to engage the object and releasing the biasing device couples the object to the support structure.

Further aspects, features and advantages of the present invention will become apparent from the following drawings and detailed description which is intended to illustrate but not limit the concepts of the invention.

BRIEF DESCRIPTION OF THE DRAWINGS

In the accompanying drawings, like reference numerals are used to designate like parts throughout the detailed description to assist the reader's understanding, and wherein.

DETAILED DESCRIPTION OF THE PREFERRED EMBODIMENT

The preferred embodiment of the adjustable mounting bracket is illustrated in the context of a bracket that couples a window treatment headrail to a ceiling. The principles of the present invention, however, are not limited to window treatment headrails or ceilings. Instead, it will be understood by one skilled in the art, in light of the present disclosure, that the invention disclosed herein can be used in connection with other types of objects which require coupling to other types of support surfaces. For example, the bracket can couple track lighting to a ceiling or a wall. For another example, the bracket can couple a towel rack or dispenser to a wall or jamb. Thus, it will be understood that the bracket of the present invention can secure objects having at least two spaced ends or sides, such as framed pictures, signs, fixtures, shelves, rails, microwaves or other appliances and the like, to a variety of support surfaces, such as a ceilings, walls, jambs and the like.

Figure 1:
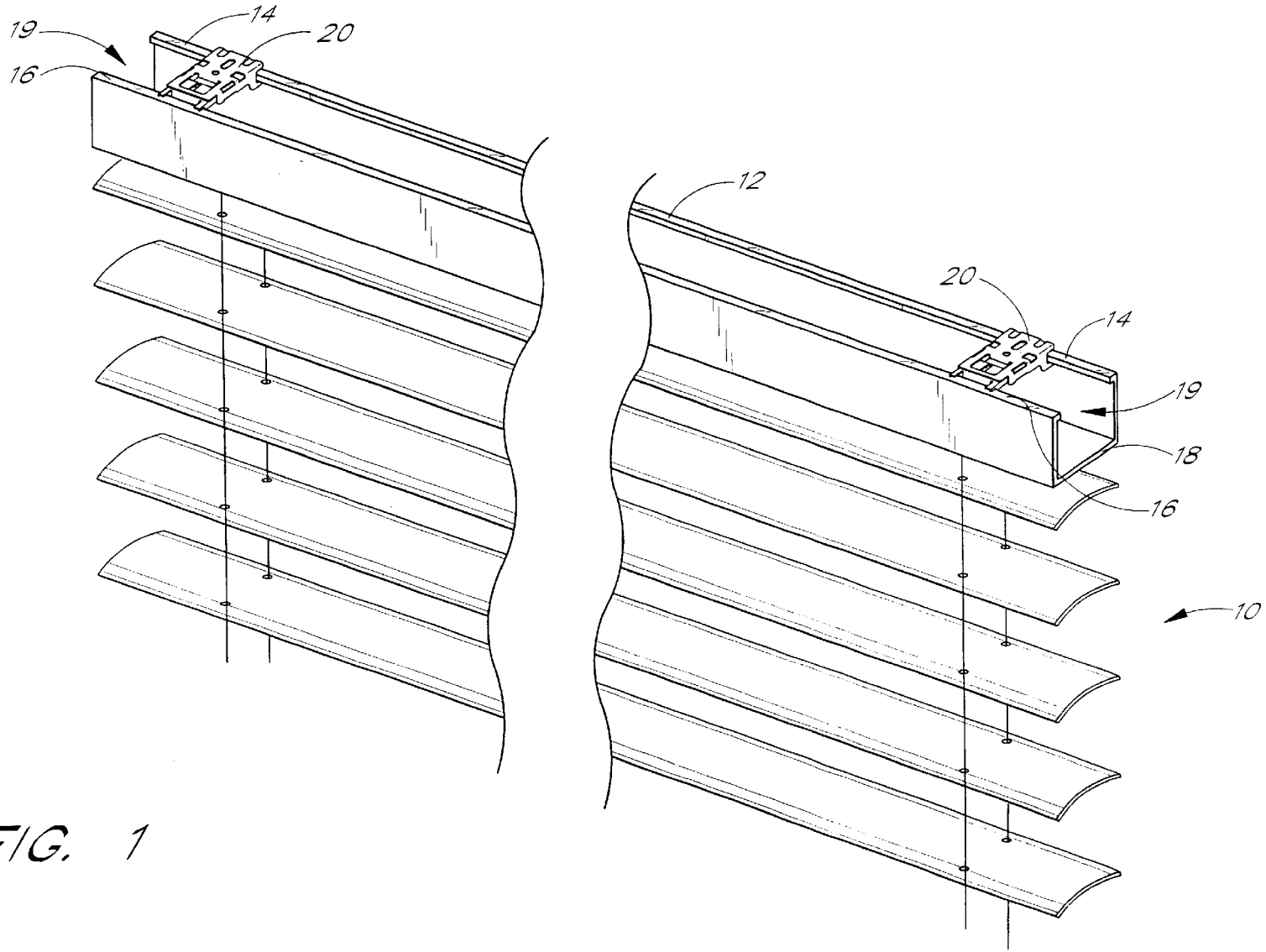
FIG. 1 is a perspective view of the mounting bracket of the present invention and illustrates the general orientation of the bracket when used with a headrail attached to a window treatment.

FIG. 1 shows the general orientation of the bracket and illustrates a window treatment 10 depending from a headrail 12. The headrail has a conventional construction comprising first and second rails or walls 14, 16 connected by a support web 18 to form a generally U-shaped channel 19.

COMPONENT PARTS

Figure 2:
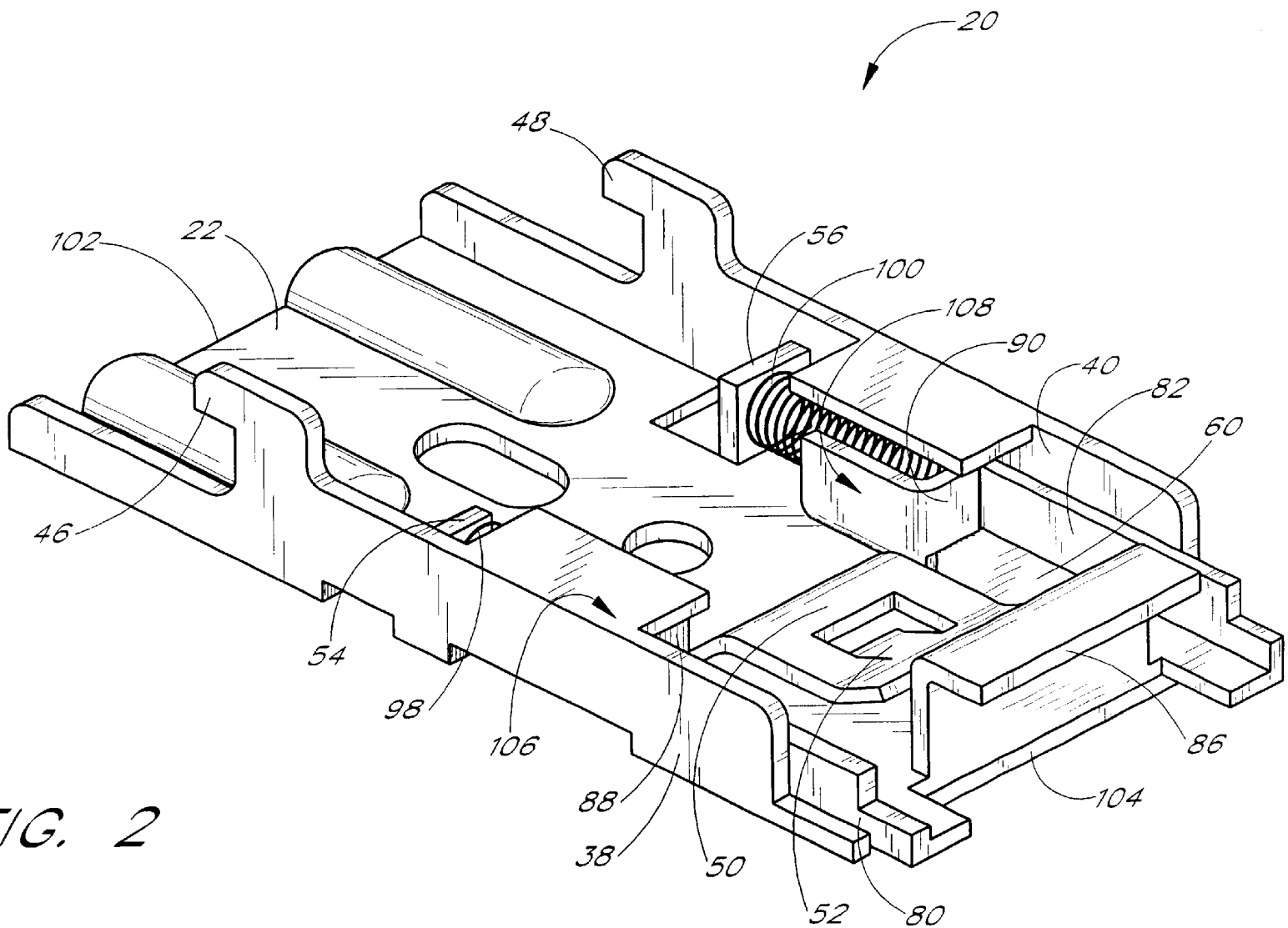
FIG. 2 is a perspective view of the bracket of FIG. 1, showing the assembled bracket.
Figure 3:
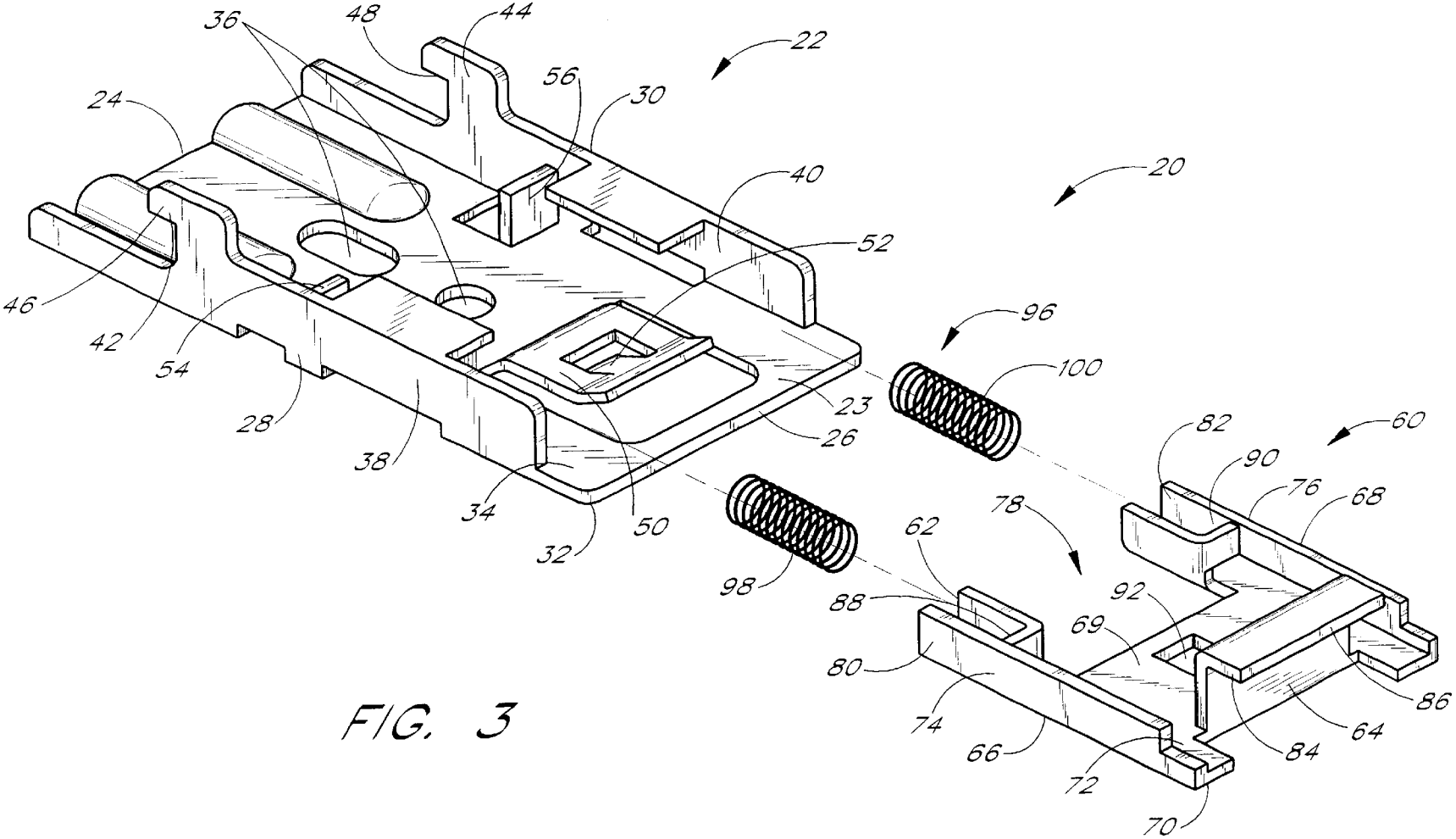
FIG. 3 is an exploded perspective view of the bracket of FIG. 2.

Referring to FIGS. 2 and 3, the bracket 20, includes an inner body 60 having one or more hooks 86 and an outer body 22 having one or more hooks 46, 48. The inner body 60 is arranged to longitudinally slide within the outer body 22 and hence at least a portion of it overlaps the outer body. This arrangement provides variable adjustment of the longitudinal length of the bracket 20, as defined by the combined overlapping longitudinal lengths of the inner and outer bodies 22, 60. A biasing device 96, preferably one or more springs 98, 100, is located at least partially between the overlapping portions of the inner and outer bodies 22, 60. The biasing device 96, when compressed, provides a force capable of biasing the bracket 20 back towards its original uncompressed length.

The outer body 22 has a generally elongate channel configuration with a first end 24 and a second end 26, a first side 28 and a second side 30, and a generally flat central wall 23 having a first surface 32 and a second surface 34. The first side 28 lies generally between one set of lateral ends of the central wall 23 and the second side 30 lies generally between an opposite set of lateral ends of the central wall 23. The outer body 22 has one or more holes 36 in the wall 23 to allow a conventional screw or similar coupling device to pass therethrough and connect the outer body 22 to the support surface.

A first rail 38 depends from the outer body 22 along the first side 28 and a second rail 40 depends from the outer body 22 along the second side 30. The rails 38, 40 are preferably smooth to facilitate sliding relative to other rails (detailed below).

A pair of generally L-shaped protrusions 42, 44 respectively extend from the first end 24 of the outer body 22. The first protrusion 42 extends from the first rail 38 to form a first hook 46 and the second protrusion 44 extends from the second rail 40 from a second hook 48.

Figure 4:
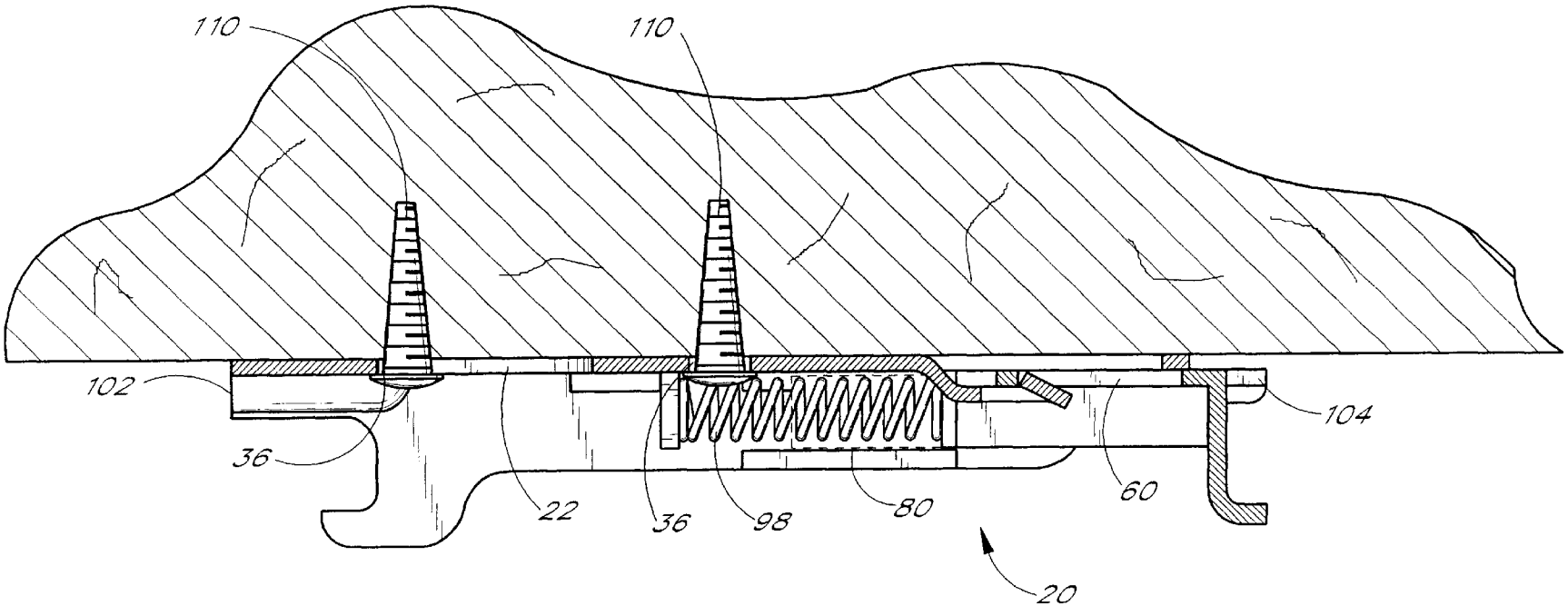
FIG. 4 is a cross sectional view of the bracket of FIG. 1 mounted onto a ceiling with a bracket spring in an unbiased position.

The first surface 32 is preferably generally smooth and planar to facilitate a flush mount with the support surface, as best shown in FIG. 4. At least a portion of the second surface 34 is also preferably generally smooth and planar to facilitate sliding of the inner body (detailed below). The second surface 34 also has an offset portion 50 formed toward the second end 26 of the outer body 22 which creates a slot between it and the second surface 34. A catch 52 on the portion 50 extends into the slot. A pair of stops 54, 56 bent away from the wall 23 are respectively formed adjacent to the first and second sides 28, 30 of the first surface 34.

Still referring to FIGS. 2 and 3, the inner body 60 has a first end 62 and a second end 64, a first side 66 and a second side 68, and a central wall 69 having a first surface 70 and a second surface 72. Like the outer body 22, the first side 66 of the inner body 60 lies generally between one set of lateral ends of the inner body 60 and the second side 68 lies generally between an opposite set of lateral ends of the inner body 60. A pair of walls 74, 76 extend from the sides of the first end 62 of the inner body 60. The walls 74, 76 define a recess 78 within the inner body 60.

A first rail 80 extends from the inner body 60 along the first side 66 and first extension 74, and a second rail 82 extends from the inner body 60 along the second side 68 and second extension 76. The rails 80, 82 are preferably smooth to facilitate sliding relative to the outer body rails 38, 40.

A generally L-shaped protrusion 84 extends from the second end 64 of the inner body 60 to form a hook 86.

The first surface 70 is preferably generally smooth and planar to facilitate sliding relative to the second surface 34 of the outer body 22. The second surface 72 has a pair of stops 88, 90 respectively formed toward the first and second sides 66, 68 of the second surface 72. The second surface 72 also has a hole or depression 92 for receiving the catch 52 of the outer body 22.

Figure 6:
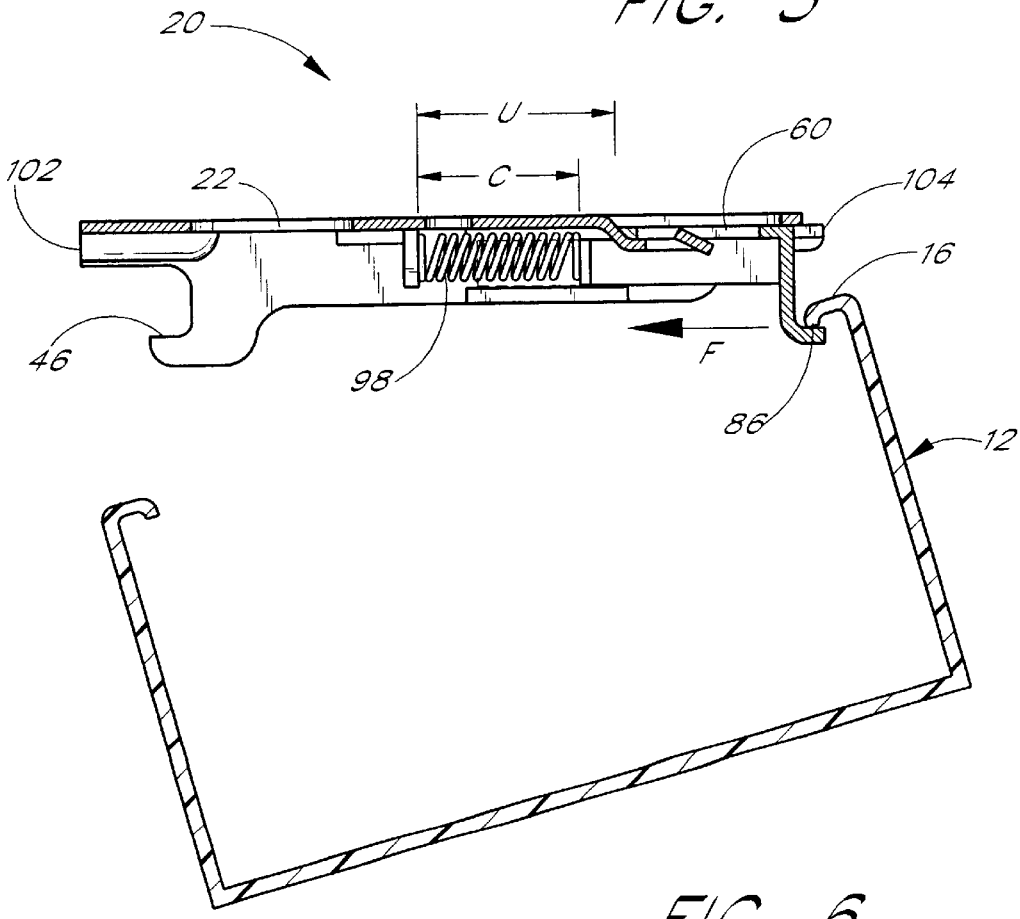
FIG. 6 is a view similar to FIG. 5, showing a force applied to the bracket which decreases the length of the bracket and compresses the spring.

The biasing device 96 provides a force that can bias the bracket 20 from a compressed position of the biasing device 96 (FIG. 7) to an uncompressed position of the biasing device 96 (FIG. 6). The illustrated embodiment shows the biasing device as a pair 96 of resilient springs 98, 100 with a helical construction, however, springs of other construction can be used to provide the bias force. Moreover, as described in greater detail below, other resilient devices can be used to provide the bias force.

ASSEMBLY

Referring to FIGS. 2, 3 and 4, when the bracket 20 is assembled, the outer body 22 extends over and around at least a portion the inner body 60, with the outer body rails 38, 40 laterally capturing at least a portion of the inner body rails 80, 82. The first end 24 of the outer body 22 forms the first end 102 of the bracket 20 and the second end 64 of the inner body 60 forms the second end 104 of the bracket 20.

The slot formed by the offset portion 50 of the outer body 22 is sized and configured to receive the wall 69 with the catch 52 extending into the hole 92 of the inner body 60 as the inner body rails 80, 82 move or slide relative to the outer body rails 38, 40. Movement of the inner body rails 80, 82 is limited by interaction between the hole 92 and the catch 52. That is, when the catch 52 contacts one end of the elongated hole 92, movement in that direction is stopped. Similarly, when the catch 52 contacts the opposite end of the hole 92, movement in that direction is stopped. As described in greater detail below, the biasing device 96 can be used to inhibit, or stop, movement of the inner body rails 80, 82 before the catch 52 contacts either end of the hole 92.

The first spring 98 is located between the first inner body stop 88 and the first outer body stop 54. The second spring 100 is similarly located between the second inner body stop 90 and the second outer body stop 56. Preferably, at least a portion of the material which forms the bodies 22, 60 is bent to form housings 106, 108 that surround at least a portion of each spring 98, 100 to inhibit escape of the spring 98, 100, from the housings 106, 108.

OPERATION

Referring to FIGS. 4–8, a preferred procedure to attach the headrail 12 to the bracket 20 is shown. The attachment is made through an easily applied pushing force applied after the bracket 20 is mounted to the support surface. FIGS. 4–8 show a portion of the first inner body rail 80 in phantom to more clearly illustrate the spring compression.

Referring to FIG. 4, the assembled bracket 20 is mounted onto a ceiling via screws 110 that extend through the holes 36 in the outer body 22 of the bracket 20. The headrail is not yet shown attached to the bracket.

Figure 5:
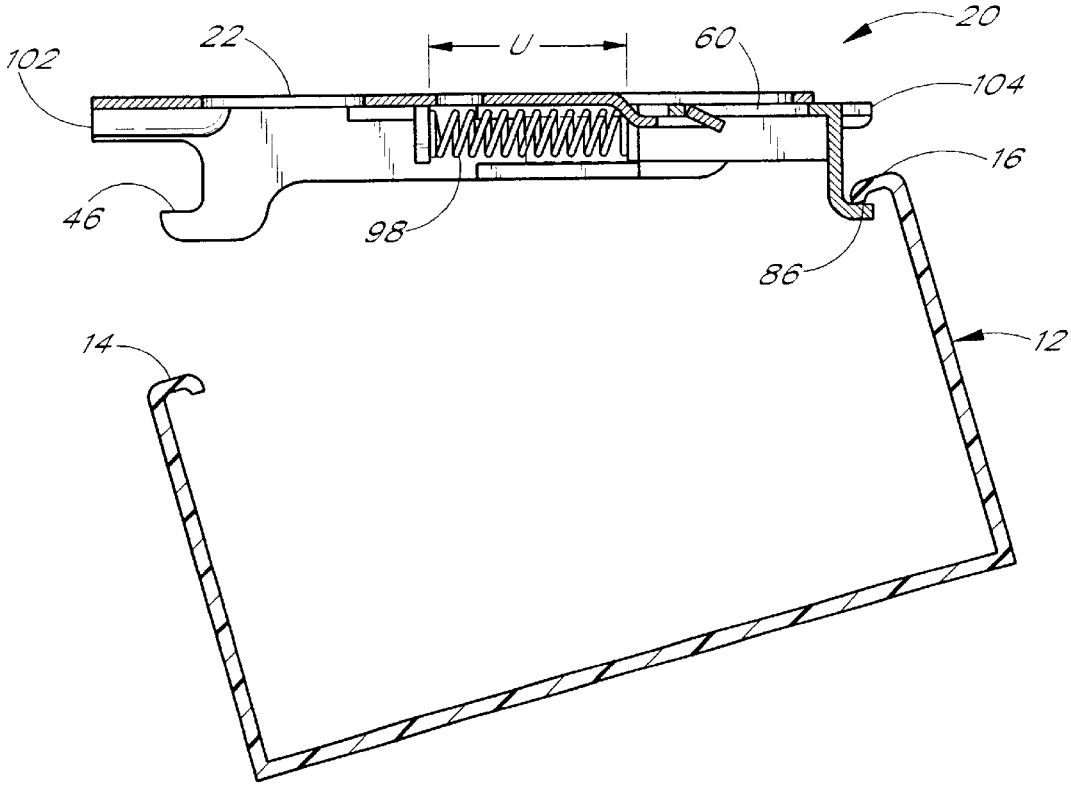
FIG. 5 is a view similar to FIG. 4, showing the first end of the headrail hooked onto a hook formed on the first body and a spring in an uncompressed position.

Referring to FIG. 5, the second rail 16 of the headrail 12 is advanced to the second end 104 of the bracket 20 (i.e. second end 64 of the inner body 60). The second rail 16 of the headrail 12 is then hooked onto the hook 86 of the inner body 60.

Referring to FIG. 6, a force F is applied to the second rail 16 of the headrail 12. At least a component of the force F is in the longitudinal direction from the second end 104 of the bracket 20 (i.e. inner body 60) towards the first end 102 of the bracket 20 (i.e. outer body 60). The force F advances the second end 104 of the bracket 20 toward the stationary first end 102 of the bracket 20. Recall that the outer body 22 is stationary and cannot move because it is screwed into the ceiling. The advancement of the first end 102 of the bracket 20 toward the stationary second end 104 of the bracket 20 decreases the overall length of the bracket 20, as explained above. The applied force F also compresses the springs 98, 100 from uncompressed distance U to compressed distance C.

Figure 7:
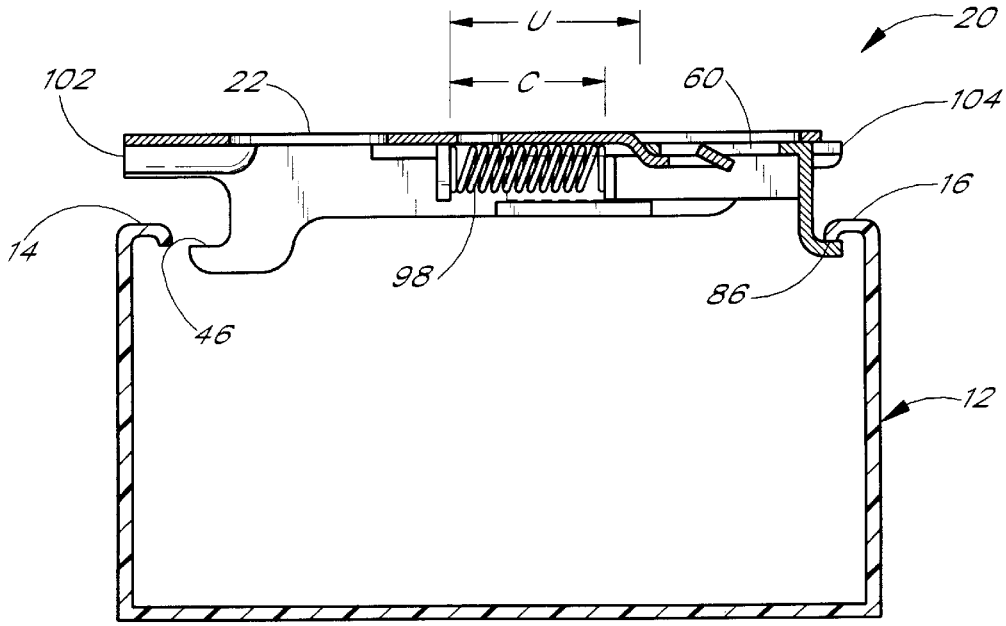
FIG. 7 is a view similar to FIG. 6, showing the headrail rotated and the second end of the headrail spaced beyond and over a hook formed on the second body.

Referring to FIG. 7, the second rail 16 of the headrail 12 is then pivoted so that the first rail 14 of the headrail rotates upward, longitudinally beyond the hooks 46, 48 on the first end 102 of the bracket 30 (i.e. outer body hooks 46, 48).

Figure 8:
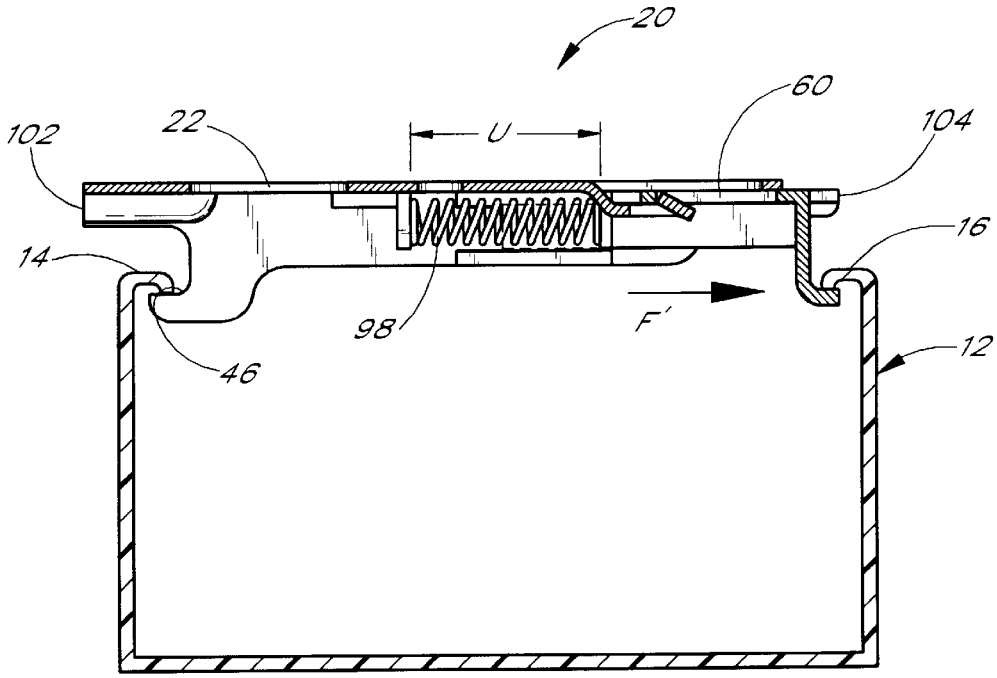
FIG. 8 is a view similar to FIG. 7, showing the force released from the bracket which allows the spring to return toward its original position and causes the second end of the headrail to hook onto the hook formed on the second body.

Referring to FIG. 8, as the applied force F is removed from the bracket 20, the compressed springs 98, 100 exert an opposing force F' in the longitudinal direction from the first end 102 of the bracket 20 toward the second end 104 of the bracket 20. The spring force F' advances the second end 104 of the bracket 20 (i.e. inner body 60) back toward its original position when the spring was uncompressed. The advancement of the second end 104 of the bracket 20 back toward its original position increases the overall length of the bracket 20. As the length increases, the first rail 14 of the headrail hooks onto the hooks 46, 48 on the first end 102 of the bracket 20 (i.e. outer body) 22. As the second end 104 of the bracket 20 continues to advance in the longitudinal direction and the bracket 20 length continues to increase, the second end 104 of the bracket 20 contacts the second rail 16 of the headrail 12, which stops further advancement of the second end 104 of the bracket 20. Advantageously, when the second end 104 of the bracket 20 contacts the second rail 16 of the headrail 12, the springs 98, 100 are partially compressed. This partial compression provides a spring force F' from the bracket 20 onto the headrail 12 that continues to bias the bracket 20 toward the headrail 12 and tends to keep the headrail 12 in place and inhibit dislodgment of the headrail 12 from the bracket 20.

Although the illustrated embodiment exemplararily shows the outer body 22 having two hooks 46, 48 and the inner body 60 having one hook 86, either body 22, 60 can be configured with one or more hooks to hook onto either rail 14, 16 of the headrail 12. Further, although the illustrated embodiment shows the outer body 22 arranged on top of and partially surrounding the inner body 60 when the bracket 20 is attached to the ceiling, this arrangement can be inverted, and the inner body rails 80, 82 can also be configured to laterally capture the outer body rails 38, 40, or the bracket can be otherwise modified.

In the preferred embodiment, the bodies 22, 60 are constructed of a metal such as steel, chosen for its strength, light weight, low cost and ability to be manufactured with smooth surfaces. However, other materials such as plastics, ceramics, wood, composites, and the like may be used depending on the particular requirements of the bracket.

In the preferred embodiment, the outer body 22 has a longitudinal length of about 6 cm and a lateral length of about 3 cm; the inner body 60 has a longitudinal length of about 3 cm and a lateral length of slightly less than 3 cm (to allow the outer body rails 38, 40 to transversely capture the inner body rails 80, 82). The inner body recess 78 has a longitudinal length of about 1 cm and the inner body hole 92 has a longitudinal length of about 1 cm. The springs 98, 100 have uncompressed length of about 2 cm and a fully compressed length of about 1 cm, but these sizes can be varied based on the particular application of the bracket 20.

ALTERNATIVE EMBODIMENTS

Figure 9:
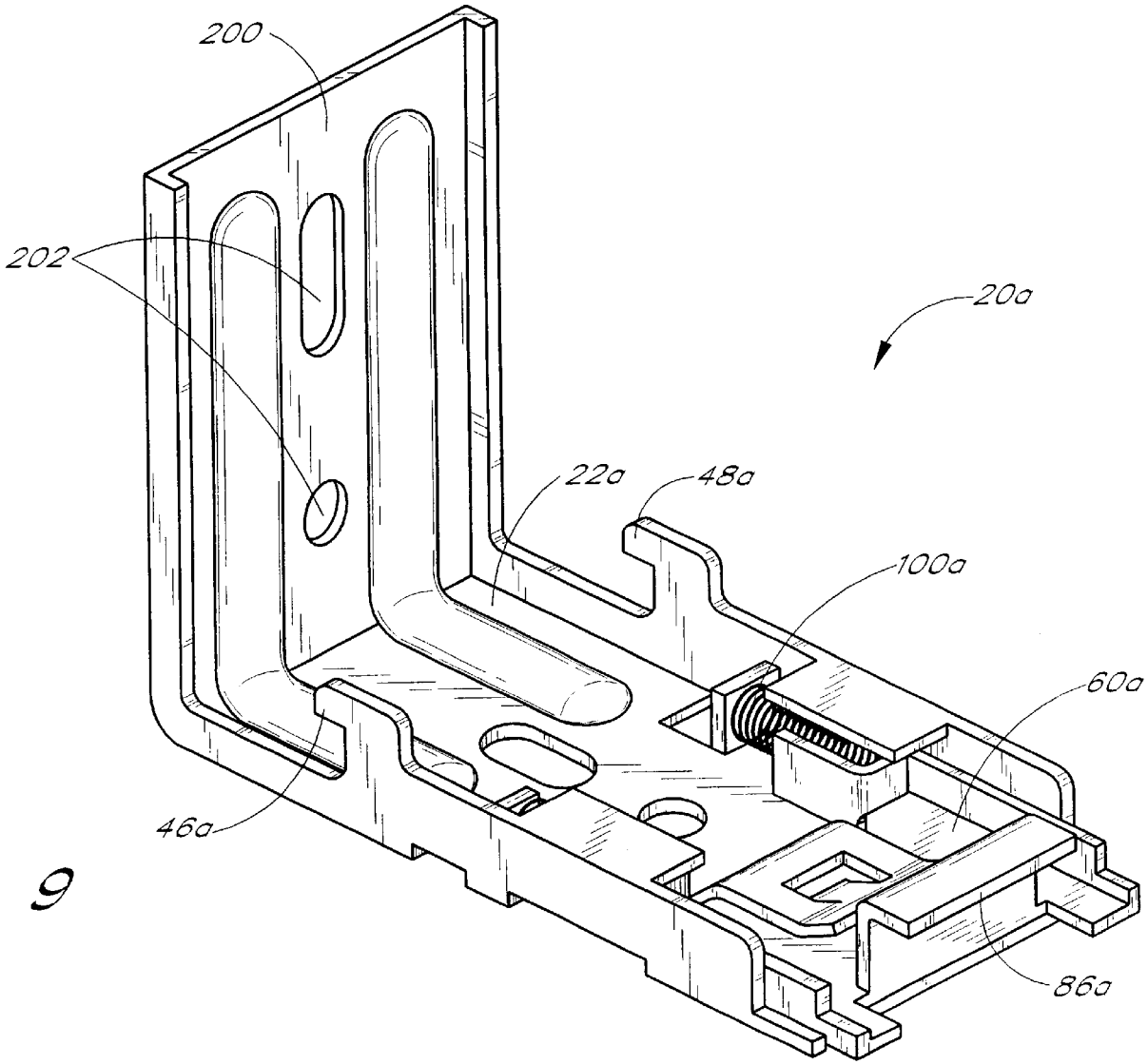
FIG. 9 is an alternative embodiment of the bracket configured to be mounted to a wall.

FIG. 9 illustrates a bracket configured in accordance with another embodiment of the invention in which the outer body differs significantly from the above-described embodiment. Accordingly, the above description applies equally to the embodiment of FIG. 9, unless indicated otherwise. In addition, like reference numerals with an "a" suffix are used to indicate like components between these embodiments to assist the reader's understanding.

FIG. 9 shows a bracket **20*a* configured to assist in coupling the headrail to a wall (not shown) instead of a ceiling. Although the previously described bracket can couple an object to the wall, the present embodiment can assist in coupling certain objects to a wall. The illustrated window treatment headrail provides one example of an object which the present embodiment of the bracket can assist in coupling to the wall The outer body 22*a* comprises a second elongated surface 200 that connects to the first elongated surface to form a generally L-shaped configuration, preferably an angle of about 90 degrees. Like the first elongate surface 22*a*, the second elongate surface 200 has one or more holes 202 so that a conventional screw or similar device can pass therethrough and connect the outer body 22*a*** to the wall.

Figure 10:
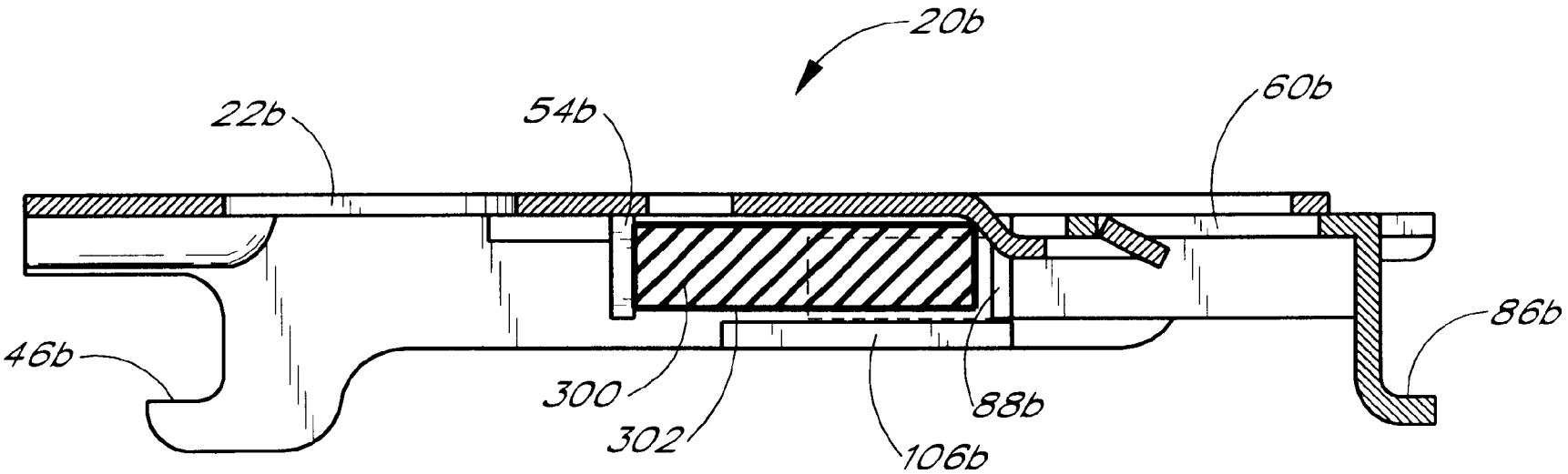
FIG. 10 is an alternative embodiment of the bracket, showing the biasing member formed as a resilient member.

FIG. 10 illustrates a bracket configured in accordance with another embodiment of the invention in which the biasing device differs significantly from the first embodiment. Accordingly, the above description should apply equally to the embodiment of FIG. 10, unless indicated otherwise. In addition, like reference numerals with an "b" suffix are used to indicate like components between these embodiments to assist the reader's understanding.

FIG. 10 shows a resilient device 300 arranged between the inner and outer body stops 54*b*, 88*b* within the housing 106*b*. The resilient device 300 may be formed of any material capable of compressing under an applied force (having the magnitude of about what a person can apply with or without the assistance of conventional hand tools), and subsequently tending to return towards its uncompressed state when the applied force is withdrawn. The illustrated embodiment shows the resilient device 300 formed of a rubber material, however, the resilient device 300 may also include materials made of spring steel, foam, silicon and the like or combinations thereof.

The resilient device 300 can be placed in an encasement 302 to assist the member 300 from not escaping from the housing 106*b*, 108*b*. This is particularly advantageous is the resilient device 300 is formed of an amorphous material. The resilient device 300 can also be formed in unity with either the outer body 22*b* or the inner body 60*b* or both bodies 22*b*, 60*b*. If unitarily formed, the resilient device 300 can extend along the entire lateral length of the outer body 22*b* or the inner body 60*b* or both bodies 22*b*, 60*b*, or only along a portion of the lateral length(s). Also, the material need not be completely resilient.

Figure 11:
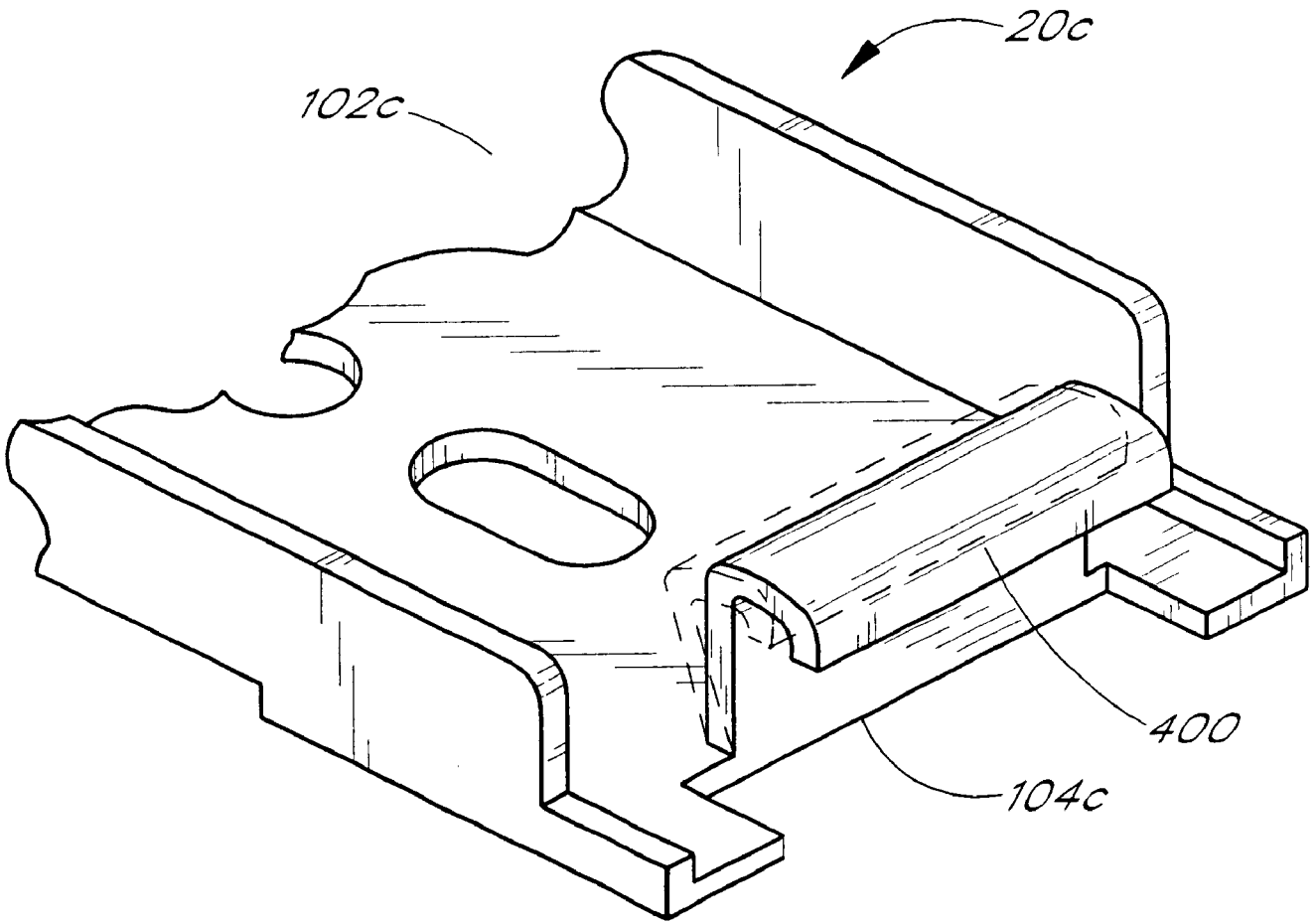
FIG. 11 is an alternative embodiment of the bracket, showing a hook formed as a movable member.

FIG. 11 illustrates a bracket configured in accordance with another embodiment of the invention in which the hook differs significantly from the first embodiment. Accordingly, the above description should apply equally to the embodiment of FIG. 11, unless indicated otherwise. In addition, like reference numerals with an "c" suffix are used to indicate like components between these embodiments to assist the reader's understanding.

FIG. 11 shows a hook 400 located on the second end 104*c* of the bracket 20*c* being longitudinally movable with respect to the opposite end 102*c* of the bracket 20*c*. The hook(s) on the first end of the bracket (not shown) can also be similarly configured. The hook 400 can be moveable by a variety of ways. For example, the portion of the hook 400 that connects to the second end 104*c* of the bracket 20*c* can be configured as a hinge. For another example the hook 400 or a portion thereof can be made of a resilient or semi-resilient material as detailed above. By this configuration, the movable hook 400 can assist the biasing device in moving the second end 104*c* of the bracket 20*c* relative to the first end 102*c* of the bracket 20*c*. Moreover, the moveable hook can entirely replace the function of the biasing device and provide the sole mechanism for movement of the second end of the bracket relative to the first end of the bracket.

FIG. 11 also shows the hook 400 being curved and generally J-shaped (i.e. not parallel to the first surface of the inner body). This curved configuration, which may be used with any of the above-described embodiments, is particularly advantageous if the headrail rails have a similarly curved configuration (i.e. not parallel to the headrail support web). Through this arrangement, the curved hooks and curved rails mate as previously described to secure the bracket within the headrail.

Although this invention has been described in terms of a certain preferred embodiment, method and suggested possible modifications thereto, other embodiments, methods and modifications apparent to those of ordinary skill in the art are also within the scope of this invention, which is defined by a fair reading of the claim which follow.

What is claimed is:

1. A method of coupling an object to a support surface, comprising the steps of:

providing a first body and a second body which overlaps the first body, the second body being insertable through a first end of the first body and movable relative to the first body;

connecting the first body to the support surface;

attaching a first end of the object to an end of the second body;

applying a force to the end of the second body so that the second body moves toward a second end of the first body opposite the first end of the first body; and releasing the force so that a bias device moves the second body back toward the first end of the first body, thereby increasing a distance between the end of the second body and the second end of the first body to capture a second end of the object.

2. The method of claim 1, wherein the attaching step includes pivoting the first end of the object so that a second end of the object rotates to a position to be attached to the first body.

3. The method of claim 1, wherein the object is a headrail.

4. The method of claim 1, wherein the first body further comprises a pair of rails formed along lateral ends thereof to form a shallow generally U-shaped configuration.

5. The method of claim 4, wherein the first body further comprises a generally L-shaped hook extending from the first body rails, the first body hook having an open end facing away from the second body for receiving the object.

6. The method of claim 4, wherein the second body further comprises a pair of rails formed along lateral ends thereof to form a shallow generally U-shaped configuration.

7. The method of claim 6, wherein the first body rails are laterally arranged so that the second body rails can slide relative to the first body rails.

8. The method of claim 4, wherein the first body further comprises a generally L-shaped hook extending from the first body rails, the first body hook having an open end facing away from the second body for receiving the object.

9. The method of claim 1, wherein a recess is formed on one of said bodies and a catch is formed on the other body, the recess and catch configured to allow relative movement between the catch and the recess.

10. The method of claim 9, wherein the catch can contact the ends of the recess to limit the relative movement.

11. The method of claim 1, wherein the bias device comprises a spring.

12. The method of claim 11, wherein a portion of the second body and a portion of the first body comprise a housing surrounding least a portion of the spring.

13. The method of claim 1, wherein the biasing device comprises a resilient material.

14. The method of claim 1, wherein the first body is generally L-shaped and further comprises a hole.

* * * * *